United States Patent [19]

Crabb, Jr.

[11] 4,380,908

[45] Apr. 26, 1983

[54] METHOD AND APPARATUS FOR CHILLING PRODUCE

[75] Inventor: Richard V. Crabb, Jr., Aromas, Calif.

[73] Assignee: Growers Ice Company, Salinas, Calif.

[21] Appl. No.: 347,503

[22] Filed: Feb. 10, 1982

[51] Int. Cl.[3] ..... F25D 17/02

[52] U.S. Cl. ..... 62/64; 53/440; 62/237; 62/298; 62/373; 426/524

[58] Field of Search ..... 62/60, 64, 237, 298, 62/373; 53/440; 426/524

[56] References Cited

U.S. PATENT DOCUMENTS

| | | | |
|---|---|---|---|
| 2,465,614 | 3/1949 | Spiegl | 426/524 |
| 2,602,303 | 7/1952 | McLain et al. | 62/1 |
| 2,640,328 | 6/1953 | Myers | 62/19 |
| 2,717,319 | 9/1955 | Bundy | 62/64 |
| 2,812,643 | 11/1957 | Worschitz | 62/237 |
| 2,901,891 | 9/1959 | Morrison | 62/60 |
| 3,477,243 | 11/1969 | Schroeder et al. | 62/237 |
| 4,249,388 | 2/1981 | Burns | 62/60 |

*Primary Examiner*—Ronald C. Capossela
*Attorney, Agent, or Firm*—Gerald L. Moore

[57] ABSTRACT

This invention relates to the preparation of produce in shipping containers for shipment to the market. Perishable produce must be chilled to near 32 degrees Fahrenheit for shipment and for this purpose ice is injected into the shipping cartons to chill and maintain chilled the produce. This invention relates to a method and apparatus for injecting a water-ice mixture into the cartons prior to shipment.

8 Claims, 4 Drawing Figures

METHOD AND APPARATUS FOR CHILLING PRODUCE

BACKGROUND OF THE INVENTION

Perishable produce such as broccoli and celery are harvested in the field, packed into shipping boxes, and transported to the market. In the past, many of these products have been harvested and shipped to a central packing house for insertion into cartons. To reduce costs, many of the products are now harvested and packed into shipping cartons in the field and thereafter transported to a packing house for cooling and loading onto vehicles for shipment to the market. One of the more common methods of cooling is the placing of crushed ice or an ice-water mixture over the product for depositing ice on the product to maintain it cool during shipping. It is necessary that the product be cooled to near 32 degrees to prevent a deterioration during shipping.

If the product is to be packed at a central station, it is fairly easy to insert crushed ice or a liquid ice mixture at that time. For instance, in the U.S. Pat. No. 4,249,388, Automatic Liquid Ice System with Daniel Burns as Inventor and issued on Feb. 10, 1981, the filled cartons are transported along a conveyor system and ice is automatically inserted through the open top. However, if the product is packed into the shipping carton in the field, this method requires the reloading of the cartons on the conveyor and the opening of the cartons so that the ice can be inserted. The depositing of ice on the product is advantageous in that the cooling effect remains for several hours in a refrigerated vehicle until the ice melts. Additionally, the presence of water reduces the dehydration rate of the product. In some instances products such as chickens packed in cartons are shipped with ice injected into the cartons in the same manner as with produce.

Various attempts have been made to speed up or automate the process of cooling the product in the cartons. For instance, in U.S. Pat. No. 2.640,328, Car and Produce Chilling System with David Myers as Inventor and issued on June 2, 1953, the boxes containing produce are loaded into railway vehicles and cold water is pumped into the vehicle to immerse the product for chilling both the produce and the vehicle. Thereafter the water is withdrawn and ice is placed within the vehicle to maintain the lower temperature.

Also, as shown in U.S. Pat. No. 2,465,614, Produce Cooling Process with E. H. Spiegl as Inventor and issued on Mar. 29, 1949 and U.S. Pat. No. 2,602,303, Icing Machine, with H. O. McLain et al. as Inventors and issued on July 8, 1952, various processes for automating the introduction of ice and cooling liquids into the vehicles have been devised. However, in each of these instances various specialized equipment and/or transportation vehicles are necessary. Also, none provide for the bulk cooling of produce in containers for interim storage prior to being loaded into transport vehicles for shipping.

U.S. Pat. No. 2,901,891 shows a method and apparatus for preserving perishable material with W. L. Morrison as Inventor and issued on Sept. 1, 1959 does reveal shipping containers for produce with a method for cooling the produce within the shipping containers. However, in this instance a cooling gas is injected such as nitrogen and there is no provision for the insertion of ice which maintains the cooling effect and reduces the dehydration of the product.

A common method of cooling cartons of produce at the present time is to inject the ice-water mixture into each individual carton by use of a hose and nozzle assemble. The assembly appears much like that shown in U.S. Pat. No. 4,249,388 referenced before. The nozzle is inserted by hand into the handhold opening of each carton and the ice mixture injected onto the produce. Naturally this is a time-consuming and expensive way of cooling the filled cartons but it does permit the loading of the cartons in the field.

It is the purpose of the present invention to provide a method and apparatus for icing produce or product in shipping cartons without removal of the cartons from the loading pallets and in an efficient and quick manner which effectively cools the product almost instantaneously and deposits ice in the carton for maintaining the product cold during shipment.

SUMMARY OF THE INVENTION

The method of injecting a cooling solution such as a liquid ice mixture into cartons packed with produce comprising the steps of stacking the cartons with the handhold openings all facing in the same direction and bringing into contact with the stack of loaded cartons a pair of end plates which squeeze the cartons therebetween for an effective seal. Through these plates is pumped a liquid ice solution which flows through the handhold openings of the cartons and over the produce for immediately cooling the produce and for depositing ice thereon for continued cooling.

DESCRIPTION OF THE INVENTION

Figure 4:
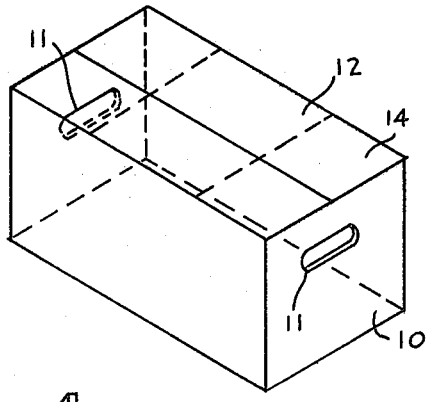
FIG. 4 shows a standard shipping carton for produce and other products.

The overall purpose of the subject invention is to inject liquid ice, a mixture of ice and water, into shipping cartons such as the carton 10 illustrated in FIG. 4. The shipping cartons usually are cardboard and are approximately 10 inches wide, 20 inches long, and 11 inches high. The cardboard material is treated so as to withstand the absorbtion of water and the overall size is dictated by the product to be shipped. For ease of handling, handhold openings 11 are cut in the opposite end walls of the carton. For filling, the top flaps 12 and 14 are left folded upwards until the carton is filled.

Figure 1:
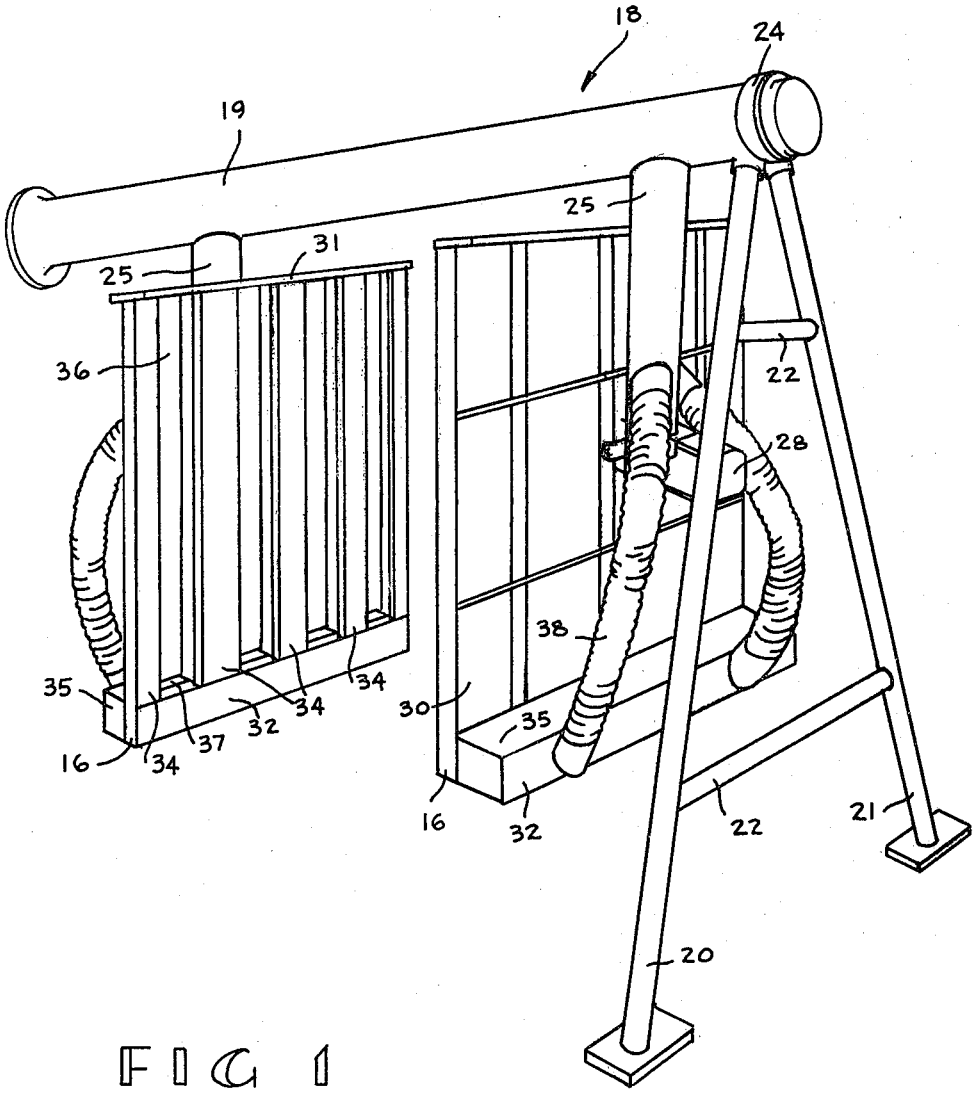
FIG. 1 is a perspective view of the apparatus for injecting the liquid ice solution into the carton stacks.
Figure 2:
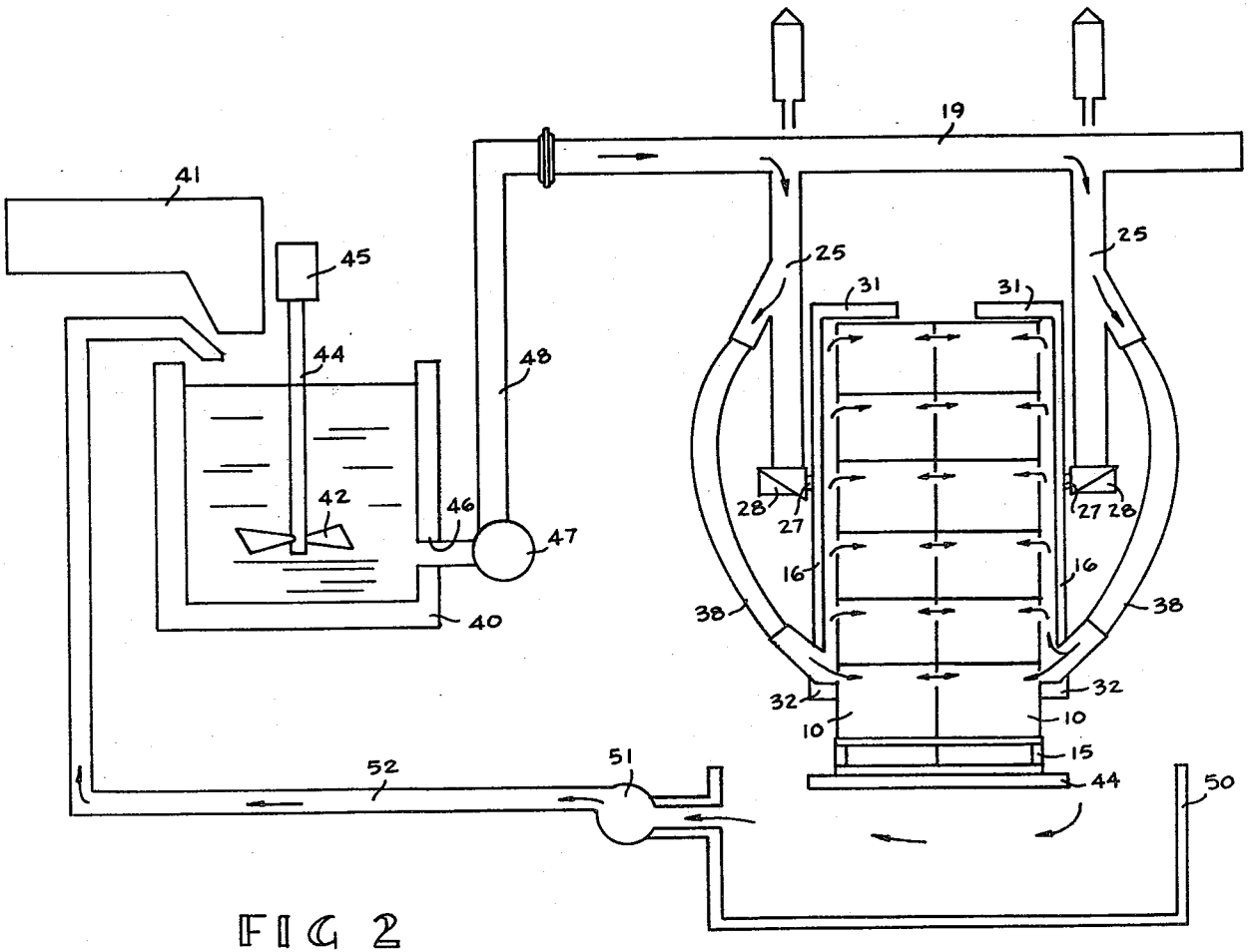
FIG. 2 is a cross sectional view of the apparatus shown in FIG. 1 with liquid ice system shown in schematic form and the carton stack in position to be cooled.
Figure 3:
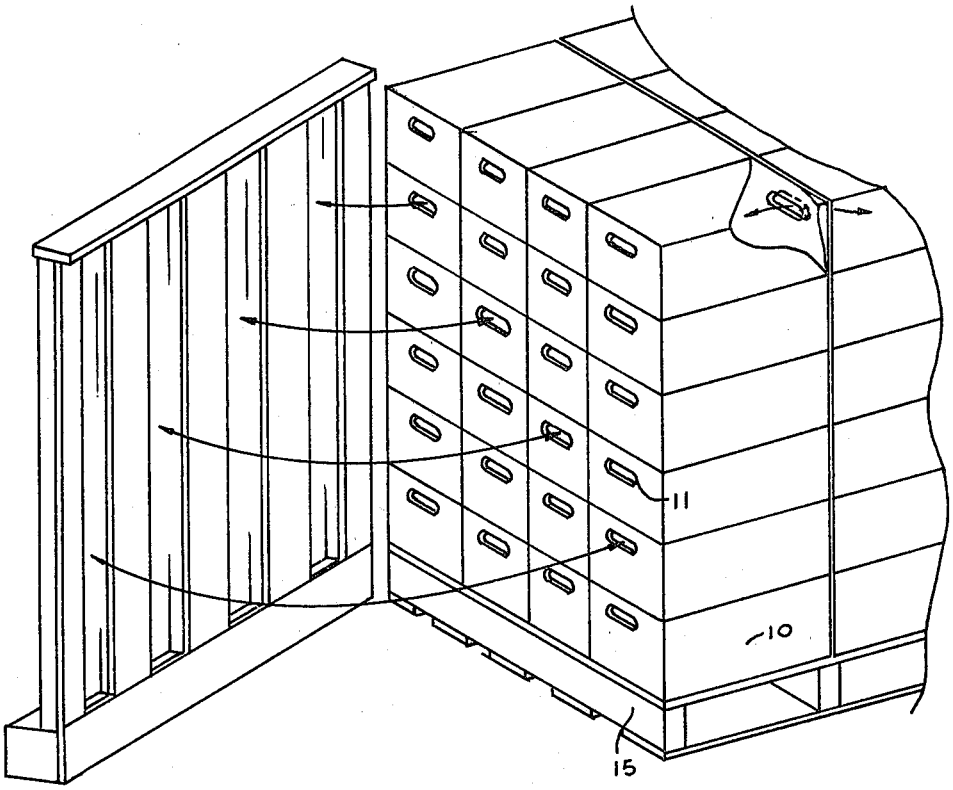
FIG. 3 shows the manner in which the plates seal against the pallet stack of shipping cartons.

Preferably, the cartons are filled in the field and are stacked on the pallet after filling. The filled cartons are stacked on pallets 15 in the manner such as shown in FIG. 3. In this instance, the pallets are stacked four wide, six high, and two deep. Stacking the cartons on pallets facilitates subsequent handling with fork-lift trucks. Such products as broccoli and celery are harvested and immediately loaded into cartons such as those described. Other produce or products can also be chilled in the manner to be described, however.

In accordance with the present invention, the cartons are loaded on the pallet 15 with the end walls forming the handholds 11 all facing in the same direction and facing outward to the side of the pallet. Usually such pallets are carried by trucks or other conveyances preferably with the handholds extending to the side. This places the carton in a position such that the end walls with the handholds are to the inside and facing the adjacent carton such that the handhold openings will align and form a passage joining the interiors of the adjacent cartons.

After the cartons have been loaded on the pallets, the conveyance is moved between a pair of plates 16 which face each other and hang vertically from a frame 18. The frame comprises a horizontal hollow pipe 19 supported at one end by legs 20 and 21 joined by suitable cross bracing 22. These legs extend to the ground and are attached at the upper end to a collar 24 extending around the pipe 19. The other end of the pipe can be supported in the same manner or can be attached to an ice-water mixture forming apparatus to be described later.

Hanging vertically from the pipe 19 are a pair of hollow uprights 25 which are spaced apart a distance somewhat greater than the width of a loaded pallet. The plates 16 are each supported on a horizontally extending shaft 27 fixed to a hydraulic actuator 28. The actuator is attached to the bottom of a hollow upright. By energization of these actuators, the plates 16 can be moved horizontally towards and away from each other.

Each plate comprises a backing member 30 terminated at the top by a flange 31 and at the bottom by a manifold 32. Extending vertically between the flange and manifold are a series of 5 equally spaced partitions 34 forming a series of 4 vertically extending passages 36. Openings 37 in the top wall 35 of the manifold 32 align with the vertical passages. Connecting with each manifold on the side opposite the plates are one end of pairs of flexible tubes 38 connecting at the other end with the hollow uprights 25.

The overall purpose of the plates is to form a flow connection with the pallet load to carry a liquid ice mixture from a tank 40 into the cartons. The tank 40 is fed water from a source (not shown) and ice from a supply 41 to form the mixture. This mixture is stirred by a propeller 42 supported on a vertically extending shaft 44 and rotated by a motor 45. This liquid ice mixture is pumped through a tank outlet 46 by a pump 47 and through a tube 48 connecting with the pipe 19. Thus the mixture can flow through the pipe and down through the hollow uprights 25 into the flexible tubes 38 and to the manifolds 32.

In operation a truck or conveyance (not shown) is positioned so as to locate the pallet load between the plates 16. These plates are sized to overlap a pallet load of specific size, which in this instance is a stack of cartons six high and four wide. When the pallet load is so positioned the actuators 28 are energized to shift the plates horizontally towards each other until they contact and form a tight seal with the end walls of the cartons. When in this position, the handhold openings 11 align with the vertical passages 36 of the side plates. Thus, with energization of the pump 47 liquid ice flows from the pipe 19 down through the flexible tubes 38, the manifold 32, and into the vertical passages. From the vertical passages, the liquid ice flows through the handhold openings and into the cartons. Since the liquid is fed from the bottom, the cartons are filled vertically and the operator views an overflow at the top of the cartons indicating that all the cartons are full. The flanges 31 extend over the top of the cartons holds the top flaps of the top cartons closed to limit the liquid ice flowing through the tops.

Thus, it can be seen that the liquid ice is caused to flow under the force of gravity into the produce filled cartons to chill the cartons and deposit ice therein for cooling the contents. The produce acts to filter the ice from the liquid as the liquid flows down through the cartons and out the bottom. Any overflow or leakage will fall into a catch basin 50 positioned beneath the conveyance carrying the pallet 15 to be pumped by pump 51 through a tube 52 for return to the tank 40. In the alternative, the contents of the catch basin can be pumped to a heat exchanger for cooling incoming water to the tank 40. The alternative embodiment is used where the overflow of liquid ice has become contaminated because of contact with the truck or other conveyance and cannot be reused.

While the present invention has been described for use in depositing an ice-water mixture in a plurality of cartons, it is equally useful for injecting the mixture into a single carton. In this example not shown in the drawings, the end plates are sized to fit over the end walls of a single carton. The flow rate of the mixture need be only enough to cause a flow through one handhold opening in a single carton.

It can be seen that the subject invention permits the chilling of a carton or a pallet load of cartons in a very short time with little or no waste of liquid ice. Thus, trucks headed for the market can be driven to the chilling station and the loads efficiently cooled. By the immediate cooling of the produce or other products in the cartons, deterioration and dehydration is reduced and the produce reaches the market in better form.

The invention claimed is:

1. The method of injecting a cooling solution into a produce carton wherein the produce carton has openings on one pair of opposing end walls, said method comprising the steps of:

providing a pair of plates having passages therein through which a cooling solution can be pumped, clamping said plates on the opposing end walls of the produce carton with sufficient force to form a seal between the carton and plate, pumping a cooling solution through said plate passages and through the carton openings into the produce carton until sufficient cooling solution is deposited in the carton to cool the produce therein, and removing the plates from the produce carton.

2. The method as defined in claim 1 including the step of reclaiming the cooling solution that overflows from the carton in a basin positioned beneath the carton.

3. The method as defined in claim 2 including the step of recirculating the reclaimed cooling solution through the plate passages.

4. The method of injecting cooling mix in a plurality of produce carrying produce cartons wherein each carton has openings in one or more side walls, said method comprising:

stacking said cartons in alignment with the corresponding sides having openings all facing the same directions, moving plates having cooling solution passages extending therethrough into contact with the carton side walls having openings with the plates being of sufficient size to cover and seal all the carton side walls facing each plate, and pumping cooling mix through the plate passages and into each carton through said side wall openings to deposit the mix in the cartons and on the produce.

5. Apparatus for injecting a cooling mixture in a carton holding a product wherein said carton has openings in opposite facing side walls, said apparatus comprising:

a pair of plates of sufficient size to fit over said carton end walls, and each forming passages therethrough, means supporting said plates for movement of each plate into sealing engagement with a carton end wall, means for forming and storing a cooling mixture, and means for pumping said cooling mixture through said plate passages after said plates are moved into engagement with a carton to deposit the cooling mixture on the product for cooling.

6. Apparatus as defined in claim 5 including means to catch and reclaim cooling mixture positioned beneath said plates and the engaged carton.

7. Apparatus for injecting a cooling mixture into a plurality of cartons stacked together with openings in the carton side walls facing the same direction, said apparatus comprising:

a pair of plates each of sufficient size to fit over the carton side walls having openings and facing the same direction with each plate forming a passage through which the cooling mixture can be passed, means supporting each plate for movement into engagement with the corresponding carton side walls, and means supplying cooling fluid to said passages through said plates to deposit cooling mixture inside said cartons.

8. The method of injecting a cooling solution into a produce carton wherein the produce carton has an opening in at least one wall, said method comprising the steps of:

providing a plate having a passage therein through which a cooling solution can be pumped, clamping said plate over said one wall of the produce carton in a manner to form a seal between the carton and plate, pumping a cooling solution through said plate passage and through the carton opening into the produce carton until sufficient cooling solution is deposited in the carton to cool the produce therein, and removing the plate from the produce carton.

* * * * *